222-135 SR
10/22/85 OR 4,548,340

United States Patent [19]
Messer

[11] Patent Number: 4,548,340
[45] Date of Patent: Oct. 22, 1985

[54] FLUSH-MOUNTED LIQUID DISPENSER

[76] Inventor: Charles L. Messer, 616 N. Curtis, Olathe, Kans. 66061

[21] Appl. No.: 598,496

[22] Filed: Apr. 9, 1984

[51] Int. Cl.[4] ..... B67D 5/52
[52] U.S. Cl. ..... 222/135; 222/181; 222/192; 4/191; 4/559; 4/605; D6/527
[58] Field of Search ..... 222/181, 180, 185, 478, 222/173, 192, 135, 129, 146.6, 183, 182; 312/242, 229; 4/191, 192, 559, 605, 630, 628; 239/282; 137/360; 220/18; D6/526, 527, 542, 544, 545

[56] References Cited

U.S. PATENT DOCUMENTS

| | | | |
|---|---|---|---|
| D. 207,095 | 3/1967 | Smith | D6/526 |
| 1,722,456 | 7/1929 | Cranmore . | |
| 1,844,557 | 2/1932 | Bobrick | 222/181 |
| 2,216,873 | 10/1940 | Browne | 220/18 X |
| 3,078,471 | 2/1963 | Knibb . | |
| 3,508,282 | 4/1970 | Phillips . | |
| 3,633,223 | 1/1972 | Killias | 4/559 X |
| 3,653,554 | 4/1972 | Turben . | |
| 3,713,585 | 1/1973 | Conklin . | |
| 3,720,352 | 3/1973 | Kozlowski . | |
| 4,019,658 | 4/1977 | Consaul . | |
| 4,027,822 | 6/1977 | Usher . | |
| 4,358,056 | 11/1982 | Greenhut et al. . | |
| 4,397,050 | 8/1983 | Davis et al. . | |

*Primary Examiner*—Joseph J. Rolla
*Assistant Examiner*—David H. Bollinger
*Attorney, Agent, or Firm*—Litman, Day and McMahon

[57] ABSTRACT

A liquid dispenser for flush-mounting in a wall includes a faceplate with front and back surfaces and inlet and outlet openings. A liquid reservoir is attached to and extends rearwardly from the faceplate back surface. A fill spout communicates with the reservoir through the inlet opening and a plunger-type pump communicates with the reservoir through the outlet opening. The fill spout and the pump extend forwardly from the faceplate front surface. The faceplate is adapted for attachment to the wall with the reservoir positioned substantially within the wall.

14 Claims, 8 Drawing Figures

FLUSH-MOUNTED LIQUID DISPENSER

BACKGROUND OF THE INVENTION

1. Field of the Invention

The present invention relates to a pump-type dispenser for liquid soap, shampoo and the like, and in particular to such a dispenser for flush mounting in a tiled wall of a bath enclosure.

2. Description of the Prior Art

Pump-type dispensers for liquid soap, shampoo and the like are well known in the prior art. Manually operable liquid soap dispensers incorporated in lavoratories are shown in the Cranmore U.S. Pat. No. 1,722,456; Knibb U.S. Pat. No. 3,078,471 and Phillips U.S. Pat. No. 3,508,282. Also, liquid soap, shampoo and the like are commonly sold in containers with plunger-type pumps. Such pumps render the contents more easily accessible than containers with screw-type caps or valves which require opening and closing. Furthermore, plunger-type pumps dispense predetermined amounts of liquid per stroke, which tends to avoid waste and guesswork.

Prior art devices have also been proposed for injecting liquids directly into a shower stream. For example, the Kozlowski U.S. Pat. No. 3,720,352 and Consul U.S. Pat. No. 4,019,658 show devices for installation in a water line connected to a shower head for introducing liquid soap, shampoo, oil and the like into the shower stream. The Conklin U.S. Pat. No. 3,713,585 discloses a mixing chamber for introducing liquid into the shower stream and a valve for dispensing liquid soap to the user. Push button valves are provided for dispensing the liquid.

However, a disadvantage with many of the prior art devices for dispensing liquids into the shower stream is that the liquids are subject to rapid depletion and waste if the mixing valve is left open. Another disadvantage is that precise metering of the liquid soap, shampoo and the like is difficult when mixed with the shower stream. Yet another disadvantage with such prior art devices is that the user has less control over the application of the liquids. For example, shampoo in the shower stream might be sprayed over the entire body rather than applied only to the hair where desired.

Of course, the original containers for liquid soap, shampoo and the like may be brought into a bath enclosure for use. However, many bath enclosures lack shelf space for the storage of such containers, which thus tend to clutter the enclosure. various types of hanging baskets have been devised for mounting in bath enclosures, but they also tend to add clutter.

Heretofore, there has not been available a dispenser for liquid soap, shampoo and the like for flush mounting in a wall of a bath enclosure with the advantages and features of the present invention.

SUMMARY OF THE INVENTION

The objects of the present invention are: to provide a dispenser for liquid soap, shampoo and the like; to provide such a dispenser which mounts flush with a wall surface; to provide such a dispenser which may be installed by removing a predetermined number of tiles in an existing bath enclosure; to provide such a dispenser which includes a plurality of reservoirs for different liquids; to provide such a dispenser with a manually operable plunger-type pump; to provide such a dispenser which may be manufactured with one or more liquid reservoirs; to provide such a dispenser which is easily cleaned; to provide such a dispenser with a plunger-type pump which is easily replaced; to provide such a dispenser which is compatible with residential bath enclosure construction; and to provide such a dispenser which is economical to manufacture, efficient in operation, and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
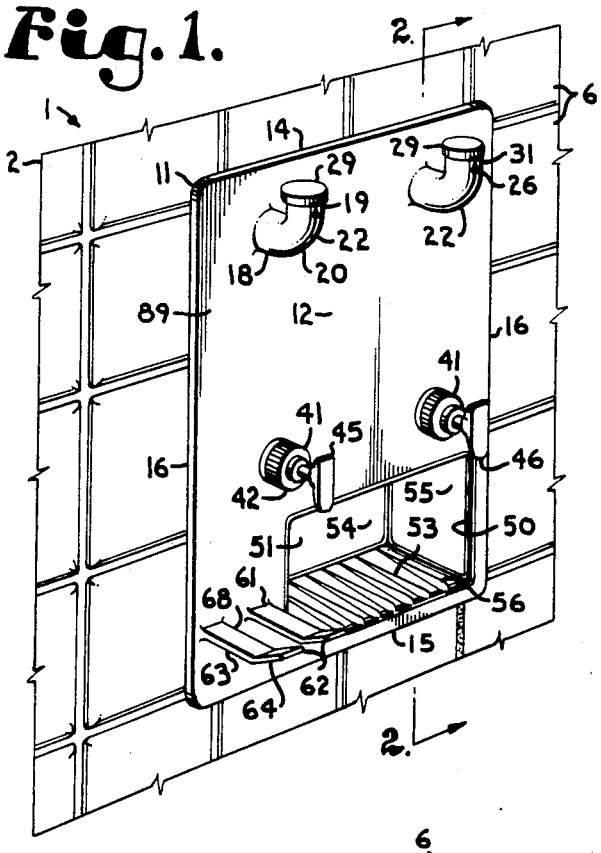
FIG. 1 is a perspective of a flush-mounted liquid dispenser embodying the present invention.
Figure 2:
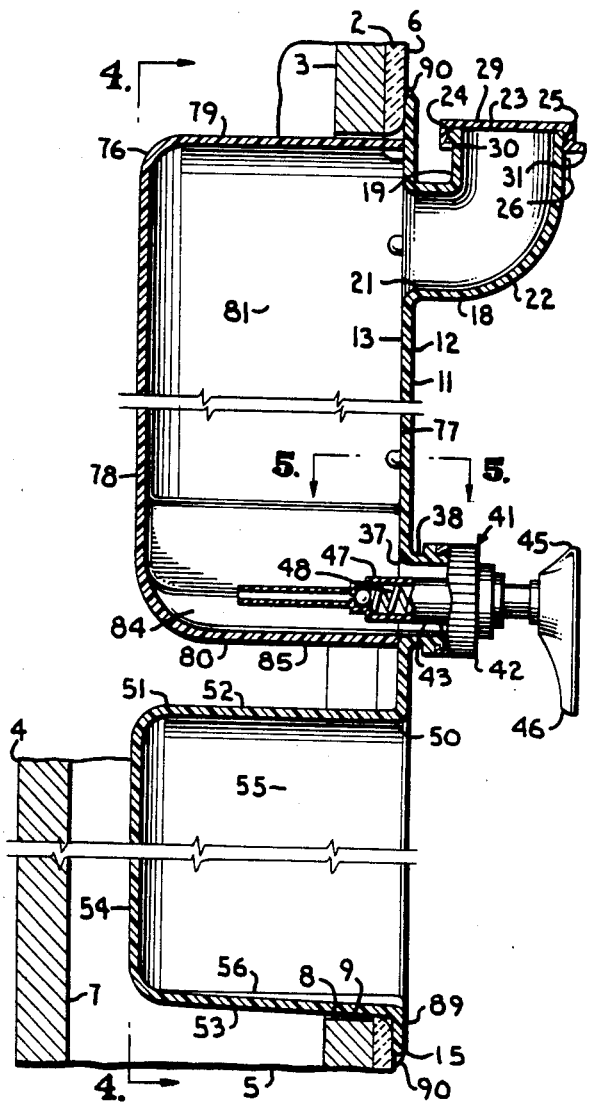
FIG. 2 is a vertical cross section of the dispenser taken generally along line 2—2 in FIG. 1.
Figure 5:
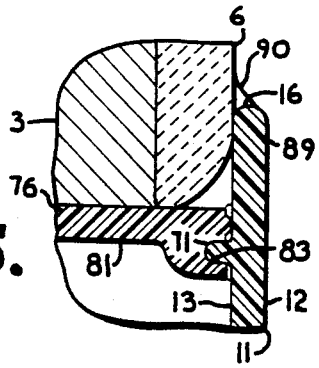
FIG. 5 is a transverse cross section of the dispenser taken generally along line 5—5 in FIG. 2.
Figure 3:
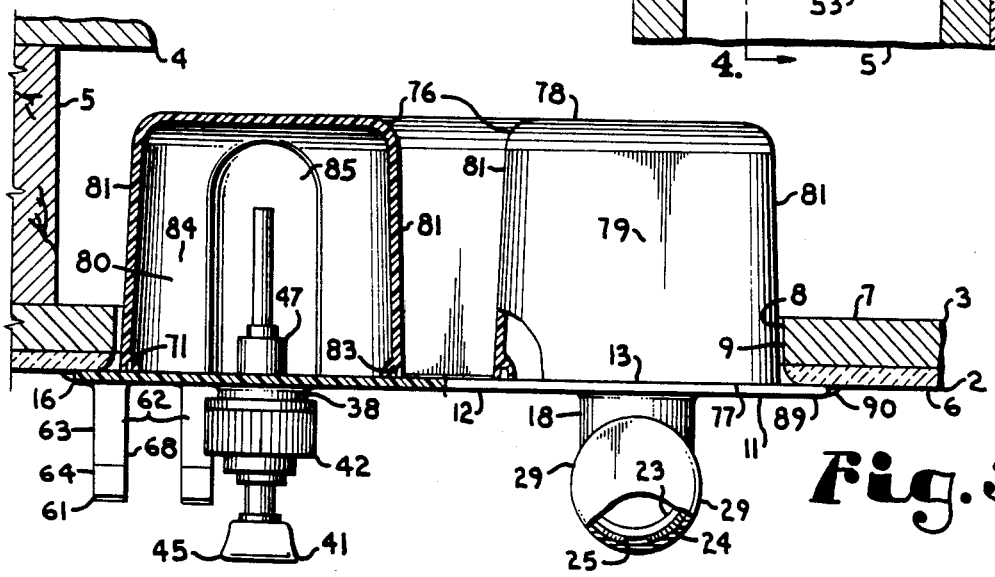
FIG. 3 is a top plan of the dispenser with portions thereof broken away to reveal internal construction.
Figure 4:
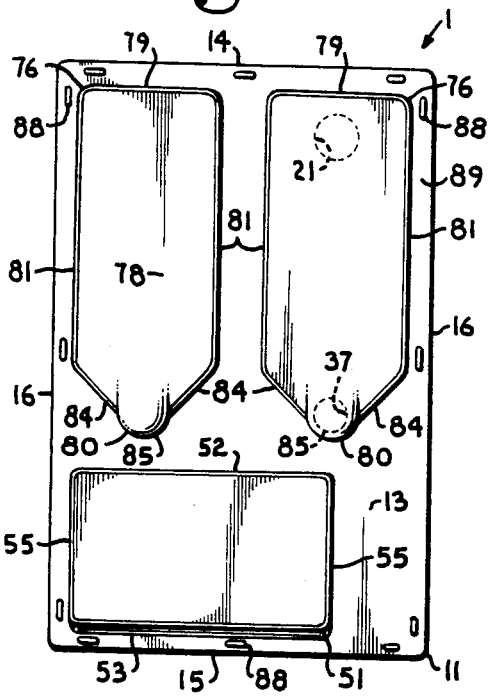
FIG. 4 is a back elevation of the dispenser.

The directions "front" and "back" refer to the invention as oriented in FIG. 1 relative to a position inside the bath enclosure.

Referring to the drawings in more detail, the reference numeral 1 generally designates a flush-mounted liquid dispenser embodying the present invention. The dispenser 1 is flush-mounted in a wall 2 comprising front and back gypsum board layers 3, 4 separated by studs 5 and forming a 3½ inch deep wall cavity 7 therebetween. A layer of 4¼ inch square ceramic tiles 6 is applied as a finish surface to the front gypsum board layer 3. The dispenser 1 comprising the present invention is particularly designed for installation in a bath enclosure including a bathtub or shower stall (not shown). Ceramic tiles such as those shown at 6 are often provided as finish wall surfaces in such bath enclosures to protect the underlying gypsum board layer from moisture. Accordingly, the liquid dispenser 1 in its preferred and modified embodiments is designed with modular dimensions corresponding to those of standard 4¼ inch square ceramic tiles. The dispenser 1 extends through an opening 8 formed by omitting or removing six tiles from an area 12¾ inches high by 8½ inches wide and removing an equivalent portion of the gypsum board front layer 3. The opening 8 has edges 9 formed by the remaining tiles 6 adjacent the opening 8 and by the front gypsum board layer 3.

The liquid dispenser 1 according to the present invention may also be usefully employed in other areas in a bathroom and in a house or other structure. For example, liquid soap may be desired at a bathroom or kitchen lavatory. Tiled walls are commonly encountered over bathroom and kitchen lavatories as well as in bath enclosures for moisture protection as aforementioned. The liquid dispenser 1 may also be mounted in walls with finish surfaces other than tile.

The liquid dispenser 1 comprises a faceplate 11 with front and back surfaces 12, 13 and upper, lower, and side margins 14, 15, and 16 respectively.

A spaced pair of inlet openings 21 extend through the faceplate 11 in proximity to its upper margin 14 and communicate with fill spouts 22 extending forwardly from the faceplate front surface 12. The fill spouts 22 comprise horizontal legs 18 and vertical legs 19 forming 90° elbows with respect to each other. The vertical legs 19 terminate at upper ends 23 having circumferential flanges 24 with cover opening notches 25. A locating arrow 26 indicates the location of the cover opening notch 25 on the front of each respective fill spout vertical leg 19.

A pair of fill spout covers 29 with circumferential, inside flanges 30 and outwardly extending tabs 31 are provided for closing the fill spout upper ends 23. The cap flanges 30 cooperate with the fill spout flanges 24 to releasably secure the fill spout caps 29 to the upper ends 23. The tabs 31 are preferably aligned with the locating arrows 26. Removal of the fill spout caps 29 is facilitated by the cooperation between the cover opening notches 25 which allow the respective flanges 24, 30 to begin their disengagement and the tabs 31 which may be manually grasped for greater leverage to initiate disengagement between the respective flanges 24, 30. The cover opening notches also facilitate placement of the fill spout caps 29 over the fill spout vertical leg upper ends 23.

A spaced pair of outlet openings 37 extend through the faceplate 11 below and in vertical alignment with respective inlet openings 21. The outlet openings 37 communicate with male-threaded outlet tubes 38 extending forwardly from the faceplate front surface 12.

A pair of manually-actuated, plunger-type pump assemblies 41 are attached to the outlet tubes 38. Each pump assembly 41 includes a cap 42 with a female-threaded bore 43 adapted to threadably receive a respective male-threaded outlet tube 38. A respective inlet tube 44 extends coaxially from the pump assembly cap 42 through its bore 43. A plunger 45 with a dispenser nozzle 46 is reciprocably mounted in the cap 42. The pump assembly 41 includes a check valve 47 providing one-way liquid flow. A helical spring 48 is provided in the check valve 47 for returning the plunger 45 to its extended position.

Plunger-type pump assemblies such as that shown at 41 are well known and a variety of different styles thereof are compatible with the present invention. Alternatively, valves may be provided in place of the pump assemblies 41. However, pump assemblies are preferred for several reasons. First of all, predetermined amounts of liquid may be accurately and consistently dispensed on each stroke of the plunger 45. Secondly, liquids having a relativey high viscosity, such as thick liquid soaps and shampoos, are more conveniently dispensed with positive pressure devices. Finally, pumps are preferred to valves because the former do not require that the reservoirs be vented to relieve vacuum and the liquid flow therethrough is not influenced by the liquid levels in the reservoirs.

A soap dish 51 is integrally formed with the faceplate 11 and extends rearwardly from a soap dish opening 50. The soap dish 51 includes a top 52, a bottom 53, a back 54, and sides 55. A plurality of ribs 56 extend from front to back on the soap dish bottom 53 for supporting a soap bar (not shown) above the soap dish bottom 53, which is inclined downwardly toward the opening 50 for drainage.

A razor holder 61 comprises a pair of spaced arms 62 extending outwardly from the faceplate outer surface 13 and each having a horizontal proximate portion 63 and an upturned distal portion 64. The razor holder 61 is adapted to support a razor with its head resting on the arm proximate portions 63 and its handle extending through a slot 68 formed between the arms 62. The razor holder 61 is positioned adjacent the soap dish 61 below a pump assembly 41.

A pair of reservoirs 76 are mounted on the faceplate rear surface 13 in juxtaposed, spaced relation. Each reservoir 76 includes a front edge 77, a back 78, a top 79, a bottom 80 and sides 81. The front edge 77 includes a plurality of locating pin receivers 83 corresponding to respective locating pins 71 extending rearwardly from the faceplate rear surface 13. The reservoir bottom 80 includes sloping bottom panels 84 adjoined to a rounded, bottom trough 85. The sloping panels 84 of the reservoir bottoms 80 tend to funnel small remaining amounts of liquid to the troughs 85 whereby substantially the entire contents of the reservoirs 76 are available to the pump assemblies 41. The reservoirs 76 are solvent welded to the faceplate rear surface 13 with the locating pins 71 inserted in respective locating pin receivers 83. Any suitable adhesive compatible with the materials comprising the faceplate 11 and the reservoirs 76 and capable of forming a fluid tight seal therebetween may be employed.

The liquid dispenser 1 is designed for installation in the space occupied by six standard 4¼ inch square ceramic tiles 6. The tiles 6 may be removed from an existing wall 2 or simply omitted from the wall 2 during construction. Thus, the liquid dispenser 1 is adapted for retrofitting in existing tiled walls and for original installation during the construction of new structures. A portion of the front gypsum board layer 3 exposed by the removed or omitted ceramic tiles 6 is removed to form the opening 8. Adhesive spots 88 are applied to a perimeter 89 of the faceplate inner surface 12. The liquid dispenser 1 is then placed in the opening 8 and the faceplate 11 is pressed against the ceramic tiles 6 whereby the adhesive spots 88 form an attachment therebetween. The faceplate 11 has slightly greater dimensions than the wall opening 8 whereby its perimeter 89 slightly overlaps the remaining ceramic tiles 6. Edges 9 of the wall opening 8 may therefore be left rough and unfinished since they are concealed by the faceplate perimeter 89.

With the liquid dispenser 1 installed in the wall 2, the reservoirs 76 are substantially located within the wall cavity 7. Each reservoir 76 has a depth of approximately 3½ inches, which corresponds to the actual width of a 2×4 stud, such as that shown at 5. Thus, the back 78 of each reservoir 76 is spaced from the back gypsum board layer 4 a distance corresponding to the thickness of the front gypsum board layer 3 and the ceramic tiles 6. A bead of waterproof caulk 90 is applied around the faceplate margins 14, 15 and 16 and the adjacent tiles 6 to seal the liquid dispenser 1 against moisture penetration behind the faceplate 11 and in the wall opening 8.

In operation, the fill spout caps 29 are removed and liquid soap, shampoo, hair conditioner and the like are poured into the reservoirs 76 through respective fill spouts 22. As the reservoirs 76 are being filled, the liquid levels therein may be observed in the fill spouts 22. The fill spout upper ends 23 are positioned above the level of the reservoir tops 79 so that even with the reservoirs 56 completely full, the liquid will not overflow.

The liquids in the reservoirs 76 are dispensed by actuating the respective plungers 45. When each plunger 45 is pushed inwardly by a user, a small amount of liquid trapped within the check valve 47 is forced from the nozzle 46. The spring 48 then reciprocates the plunger 45 to its extended position whereby an amount of fluid equal to that dispensed is drawn into the check valve 47. An advantage to using plunger-type pump assemblies 41 is that they dispense predetermined amounts of liquid on each stroke whereby the user can accurately control the amount of liquid taken from the dispenser 1.

The liquid dispenser 1 is particularly designed for ease of maintainance. For cleaning, the fill spout caps 29 and the pump assemblies 41 are removed and the reservoirs 76 are flushed out. The fill spout caps 29 and the pump assemblies 41 are easily removed from the dispenser 1 for repair or replacement. Since they comprise the only moving parts of the dispenser 1, it is believed to have an indefinite useful operating life if properly constructed and installed. Without limitation on the generality of useful materials, high impact styrene has been found to be an acceptable material for the faceplate 11 and the reservoirs 76 since it is waterproof, breakage-resistant and easily molded.

Figure 6:
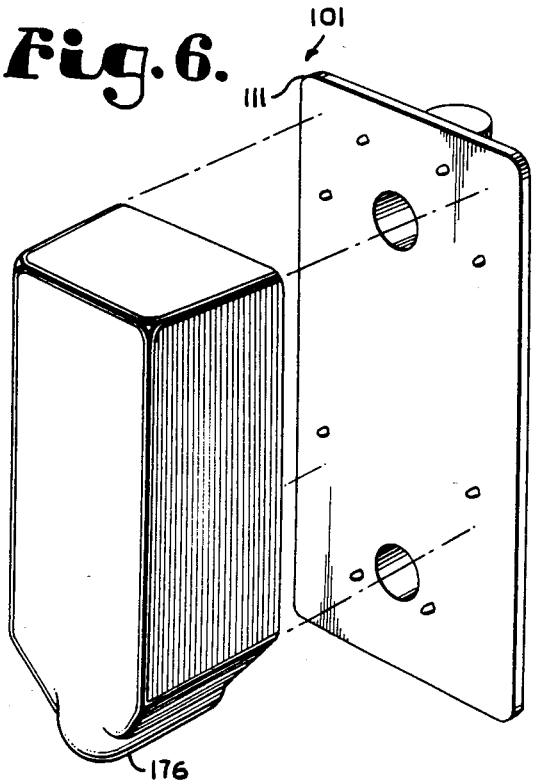
FIG. 6 is a perspective of a liquid dispenser comprising a first modified embodiment of the present invention.
Figure 7:
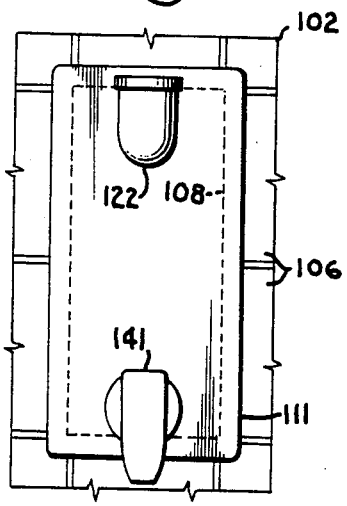
FIG. 7 is a front elevation of the modified dispenser.

A liquid dispenser comprising a first modified embodiment of the present invention is shown in FIGS. 6 and 7 and generally designated by the reference numeral 101. The liquid dispenser 101 may be considered a single version of the liquid dispenser 1 and is mounted in a wall 102 within an opening 108 formed by omitting or removing two tiles 106 positioned one on top of the other. The dispenser 101 generally comprises a faceplate 111 mounted on the tiles 6 and a single reservoir 176 glued thereto and positioned within the wall 102. A fill spout 122 and a pump assembly 141 extend outwardly from the faceplate 111. The liquid dispenser 101 is particularly well adapted for use in areas where only one liquid is required. For example, the liquid dispenser single model 101 may contain hand soap and be located adjacent a lavatory.

Figure 8:
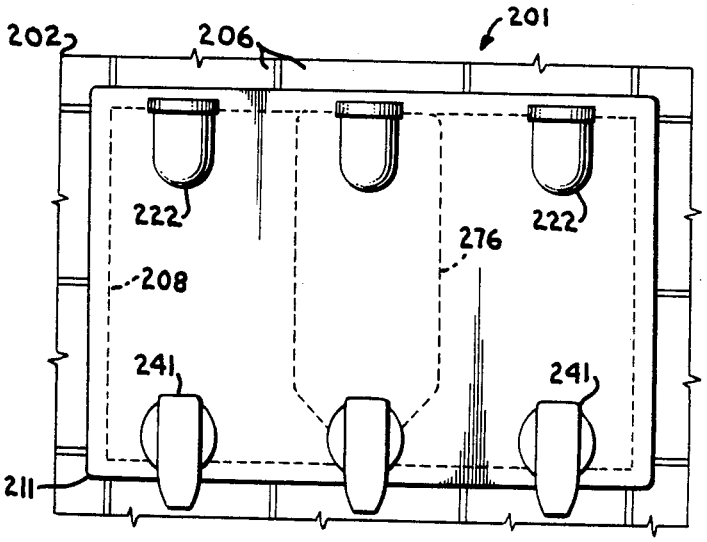
FIG. 8 is a front elevation of a liquid dispenser comprising a second modified embodiment of the present invention.

A liquid dispenser comprising a second modified embodiment of the present invention is shown in FIG. 8 and generally designated by the reference numeral 201. The liquid dispenser 201 is a triple model of the dispenser 101 and is mounted in a wall 202 within an opening 208 formed by removing or omitting six tiles 206. The liquid dispenser 201 generally comprises a faceplate 211 and three reservoirs 276 mounted thereon and positioned substantially within the wall 202. Three fill spouts 222 and three pump assemblies 241 extend forwardly from the faceplate 211.

It is anticipated that liquid dispensers according to the present invention may be formed in various combinations other than those shown and described herein. For example, the reservoirs could be positioned one on top of the other. Also, a soap dish and a razor holder may be provided with the liquid dispensers 101 and 201 comprising the first and second modified embodiments respectively.

It is to be understood that while certain forms of the present invention have been illustrated and described herein, it is not to be limited to the specific forms or arrangement of parts described and shown.

What is claimed and desired to be secured by Letters Patent is as follows:

1. A liquid dispenser for flush-mounting in a wall, which comprises:

(a) a faceplate having front and back surfaces and inlet and outlet openings extending therethrough;

(b) a liquid reservoir attached to and extending rearwardly from said faceplate back surface;

(c) a fill spout communicating with said reservoir through said inlet opening and extending forwardly from said faceplate front surface;

(d) pump means mounted on said faceplate and extending forwardly from the front surface thereof, said pump means communicating with said reservoir through said outlet opening; and (e) attachment means for attaching said faceplate to a wall with said reservoir positioned substantially within said wall.

2. The liquid dispener according to claim 1, which includes:

(a) said fill spout having a horizontal leg extending from said faceplate and a vertical leg terminating at an upper end; and (b) a fill spout cap for closing said fill spout upper end.

3. The liquid dispenser according to claim 1, which includes:

(a) a male threaded outlet tube attached to and extending forwardly from said faceplate front surface, said outlet tube communicating with said outlet opening; and (b) said pump means comprising:

(1) a cap with female threads adapted for threadable engagement with said outlet tube; and (2) a plunger reciprocably received through said cap and having a dispenser nozzle attached thereto.

4. The liquid dispenser according to claim 1, which includes:

(a) said faceplate having a perimeter positioned outwardly from said liquid reservoir and adapted for attachment to said wall.

5. The liquid dispenser according to claim 1, which includes:

(a) said faceplate having a soap dish opening; and (b) a soap dish connected to said faceplate back surface and extending rearwardly from said soap dish opening.

6. The liquid dispenser according to claim 1, which includes:

(a) a razor holder comprising a pair of spaced arms attached to and extending forwardly from said faceplate front surface, said arms forming a slot therebetween adapted to receive a razor handle.

7. A liquid dispenser for flush-mounting in a wall including front and back layers of material forming a wall cavity therebetween and a layer of tiles on said front material layer, which comprises:

(a) a faceplate having:
(1) front and back surfaces;
(2) upper, lower and side margins;
(3) a perimeter adjacent said margins;
(4) an inlet opening positioned in spaced proximity to said faceplate upper margin; and
(5) an outlet opening positioned below said inlet opening;

(b) a fill spout extending forwardly from said faceplate front surface and communicating with said inlet opening;

(c) a fill spout cap adapted for removable attachment to said fill spout;

(d) an outlet tube extending forwardly from said faceplate front surface and communicating with said outlet opening;

(e) a plunger-type pump mounted on said outlet tube;

(f) a liquid reservoir attached to said faceplate back surface and extending rearwardly therefrom, said liquid reservoir communicating with said inlet and outlet openings;

(g) said reservoir having a height and width slightly less than the height and width of an opening in said wall formed by removing a predetermined number of tiles and a corresponding portion of said front material layer;

(h) said faceplate having a height and width greater than said wall opening height and width; and (i) said liquid dispenser being adapted for mounting in said wall whereby said faceplate substantially conceals said opening and said reservoir extends through said opening into said wall cavity.

8. The liquid dispenser according to claim 7 which includes:

(a) said outlet tube including male threads; and (b) said pump assembly including a cap with female threads, a plunger reciprocably received in said cap and having a dispenser nozzle and a check valve actuated by said plunger.

9. The liquid dispenser according to claim 7, which includes:

(a) said faceplate having a soap dish opening extending therethrough; and (b) a soap dish including a top, a bottom, a back, sides and a plurality of ribs on said soap dish bottom, said soap dish being attached to and extending rearwardly from said faceplate rear surface at said soap dish opening.

10. The fill spout according to claim 7 wherein:

(a) said fill spout includes a horizontal leg extending from said faceplate and a vertical leg terminating at an upper end; and (b) said fill spout cap is attached to said upper end.

11. The liquid dispenser according to claim 10, which includes:

(a) a fill spout flange extending substantially circumferentially around said fill spout upper end; and (b) said fill spout cap having a flange adapted for releasably interlocking with said fill spout flange.

12. The liquid dispenser according to claim 7 wherein:

(a) said reservoir includes a bottom having a pair of downwardly sloping panels terminating at an upwardly-open trough extending front-to-back with respect to said reservoir;

(b) said outlet opening communicating with said reservoir at said trough.

13. The liquid dispenser according to claim 7, which includes:

(a) said reservoir having a top positioned below a level of said fill spout cap attached to said fill spout.

14. A liquid dispenser for flush-mounting in a wall having front and back layers of materials forming a wall cavity therebetween and having tiles attached to the front material layer, which comprises:

(a) a faceplate having:
(1) front and back surfaces;
(2) upper, lower and side margins;
(3) a plurality of horizontally aligned inlet openings positioned in spaced proximity to said upper margins;
(4) a plurality of horizontally aligned outlet openings, each said outlet opening being positioned in spaced relation below a respective inlet opening; and
(5) a soap dish opening in spaced proximity above said lower margin and adjacent one of said side margins;

(b) a plurality of fill spouts each including a horizontal leg attached to said faceplate front surface and a vertical leg terminating at an upper end with a flange, said fill spouts each communicating with a respective inlet opening;

(c) a plurality of fill spout caps each having a respective flange for releasable interlocking engagement with a respective fill spout flange, said fill spout caps being adapted to close said fill spout upper ends;

(d) a plurality of male, threaded outlet tubes attached to and extending fowardly from said face plate front surface, each said outlet tube communicating with a respective outlet opening;

(e) a plurality of plunger-type pump assemblies, each including a respective cap with female threads adapted for threadable engagement with the respective outlet tube, a plunger reciprocably received in said cap and having a dispenser nozzle and a check valve actuated by said plunger;

(f) a soap dish including a top, a bottom, a back, sides and a plurality of ribs on said bottom, said soap dish being attached to and extending inwardly from said faceplate back surface at said soap dish opening;

(g) a razor holder comprising a pair of arms attached to and extending outwardly from said faceplate in spaced relation to said faceplate lower margin and adjacent the other of said faceplate side margins, said razor holder comprising a pair of horizontally spaced arms each including a substantially horizontal, proximate portion and an upwardly angled distal portion, said arms forming a slot therebetween adapted to receive a razor handle;

(h) a plurality of discrete liquid reservoirs each having:
(1) a front edge;
(2) a back;
(3) a top;
(4) a bottom with a pair of downwardly-sloping panels terminating at an upwardly-open trough extending front-to-back with respect to said reservoir; and
(5) a pair of opposite sides;

(6) each said reservoir being glued along its respective front edge to said faceplate back surface whereby said reservoir is positioned in communication with respective inlet and outlet openings;

(i) a plurality of locating pins and locating pin receivers located at the connection of said faceplate back surface and said reservoir front edges;

(j) said locating pin receivers being adapted to receive said locating pins whereby said reservoirs are positioned on said faceplate back surface in predetermined positions;

(k) said faceplate back surface having a perimeter around said soap dish and said reservoirs;

(l) said dispenser being adapted for flush-mounting in said wall with said perimeter substantially covering an opening formed in said wall by removing a predetermined number of tiles and a corresponding portion of said front material layer;

(m) said dispenser being attached to said wall by adhesive spots applied to said faceplate perimeter; and (n) a caulk bead extending around said faceplate margins and forming a water-tight seal.

* * * * *